United States Patent [19]

Fowler

[11] 3,968,709

[45] July 13, 1976

[54] CARPET TILE MACHINE

[75] Inventor: James E. Fowler, Spartanburg, S.C.

[73] Assignee: Deering Milliken Research Corporation, Spartanburg, S.C.

[22] Filed: Aug. 7, 1975

[21] Appl. No.: 602,694

Related U.S. Application Data

[62] Division of Ser. No. 542,110, Jan. 20, 1975.

[52] U.S. Cl. ..... 83/1; 83/620; 83/925 R

[51] Int. Cl.[2] ..... B26D 3/08

[58] Field of Search ..... 83/1, 620, 621, 622, 83/11, 915, 918, 695, 697, 925 R

[56] References Cited

UNITED STATES PATENTS 2,143,507 1/1939 Chandler ..... 83/620 X 3,520,220 7/1970 Acker ..... 83/620 X

*Primary Examiner*—Frank T. Yost

*Attorney, Agent, or Firm*—Earle R. Marden; H. William Petry

[57] ABSTRACT

Method and apparatus to score cut the hardbacking of carpet tiles to relieve the inherent stresses therein to alleviate the tendency of the carpet tiles to pucker when laid in operative position on the floor. The back of the carpet tiles are cut by a serrated die cutter to produce an undulating configuration in the backing of the carpet tile.

1 Claim, 4 Drawing Figures

CARPET TILE MACHINE

This is a division of application Ser. No. 542,110, filed Jan. 20, 1975.

It is an object of the invention to provide a hard-backed carpet tile in which the stresses have been relieved so that the carpet tile will lay flat without puckering when installed on a floor.

Other objects and advantages of the invention will become clearly apparent as the specification proceeds to describe the preferred embodiment of the invention with reference to the accompanying drawings, in which.

Figure 4:
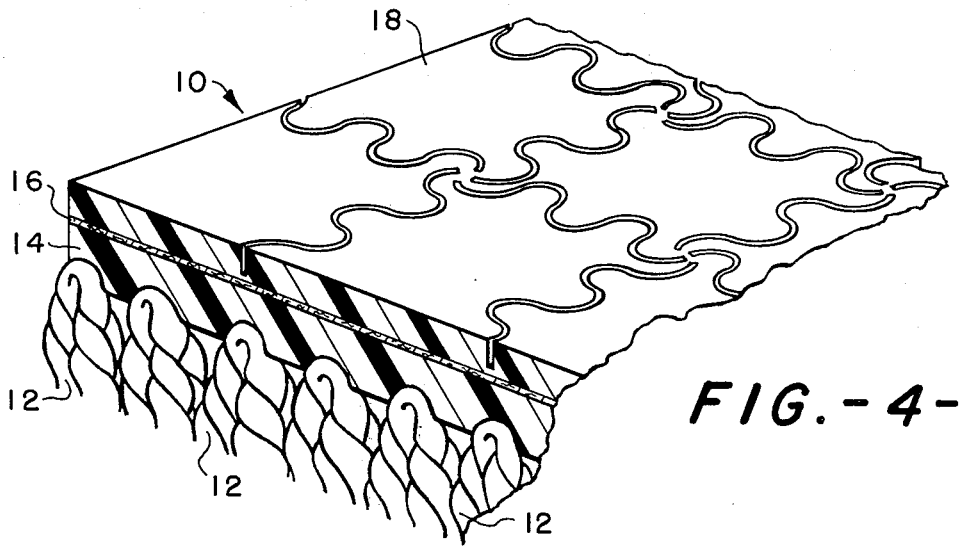
FIG. 4 is a partial perspective view of a hardback carpet tile cut to relieve the stresses therein.

Looking first at FIG. 4 a portion of a carpet tile 10 is shown basically consisting of a plurality of pile yarns 12 embedded at their bases in a normally relatively impervious adhesive layer 14, which may be polyvinyl chloride, to firmly attach the same to the surface of the scrim backing material 16. Bonded to the undersurface of the scrim backing material 16 is a second polymeric backing material 18, commonly called a hardback, which also may be, if desired, a hardened polyvinyl chloride.

Figure 1:
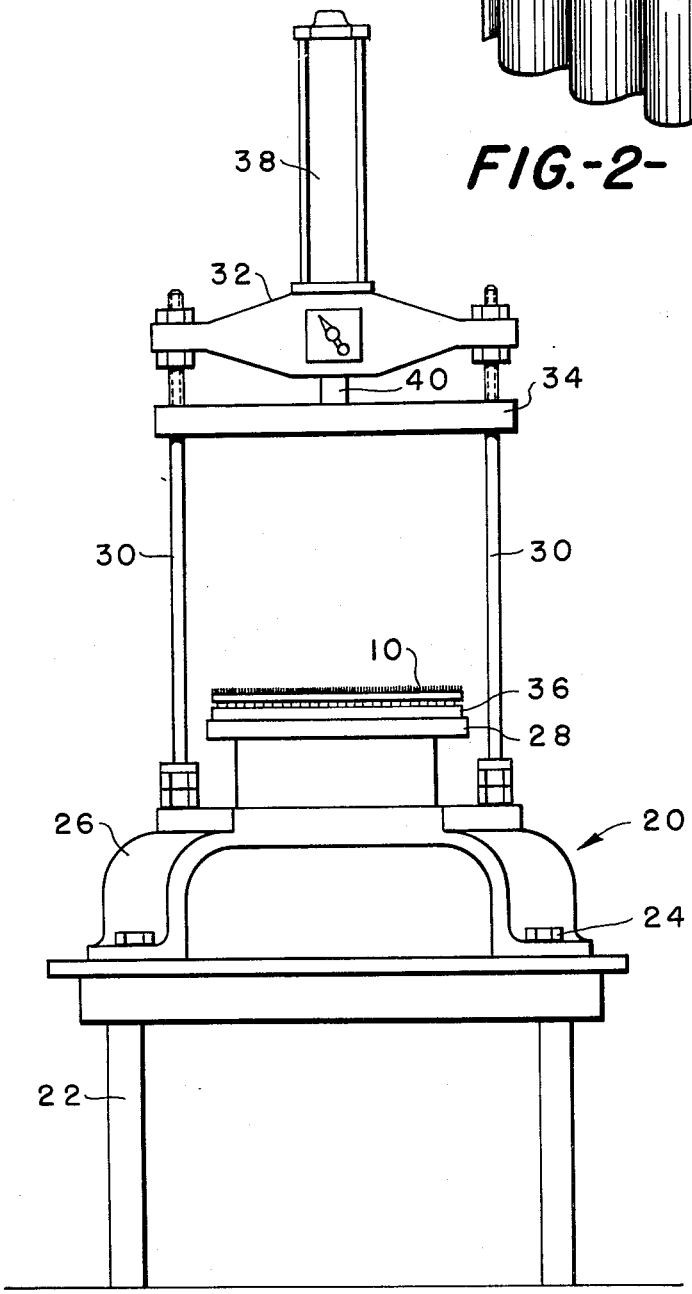
FIG. 1 shows a stamping die used to slit the hardback of carpet tiles.

As discussed briefly before one of the problems encountered in the use of hardback carpet tile is that some tiles do not lay flat after installation because of stresses therein which cause the tile to pucker. To alleviate this condition, the carpet tile cutting machine; generally designated 20 in FIG. 1, is employed to provide a plurality of corrugated cuts in the hardback backing 18 of the carpet tile 10. The carpet tile cutting machine 20 has a base 22 to which is bolted by suitable bolts 24 a frame support member 26 on which is mounted the support member 28 and a plurality of upstanding rod or post members 30 held together at the top by cross-bars 32. Slidably mounted on the posts 30 is the pressure plate 34 which cooperates with the cutting die 36 which is mounted on the support member 28. Also mounted on the cross-bars 32 is a pneumatic or hydraulically actuated piston 38 which has piston rod 40 connected to the pressure plate 34.

In operation the carpet tile 10 is placed on the cutting die 36 on the support member 28 with the hardback surface facing downwardly. The piston 38 is actuated to slide the pressure plate 34 downwardly to place the cutting die 36 into pressure contact with the tile 10. The pressure plate 34 and the cutting die are held into cutting engagement with the carpet tile 10 for about one-two seconds under a pressure of approximately 250 pds/sq. inch of pressure to ensure cutting of the hardback 18 of the carpet tile 10. Then the pressure plate is raised, the carpet tile removed, a new carpet tile to be cut is placed into cutting position and the procedure repeated.

Figure 2:
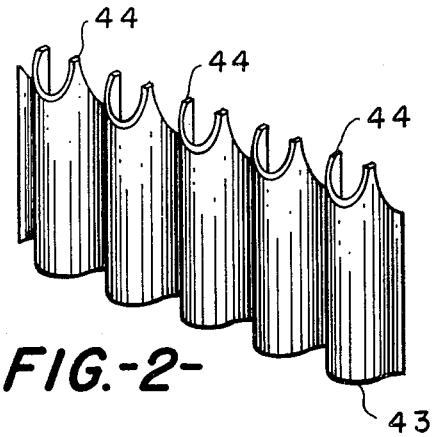
FIG. 2 is a perspective view of a portion of a cutting die used in the invention.

In the preferred form of the invention the cutting die is composed of a series of corrugated, serrated cutting members 43 which provide the configuration shown in FIGS. 2 and 4. Looking at FIGS. 2 and 4, the high points 44 of the corrugations penetrate the hardback to a depth closely adjacent the scrim layer 16 while the rest of the corrugated surface penetrates to a less deeper extent so that cutting of the hardback backing 18 to relieve stresses therein is accomplished while maintaining integrity in the backing without delamination. The corrugations of the cutting die not only provides a pleasing surface effect on the backing but eliminates straight line scoring of the hardback.

Figure 3:
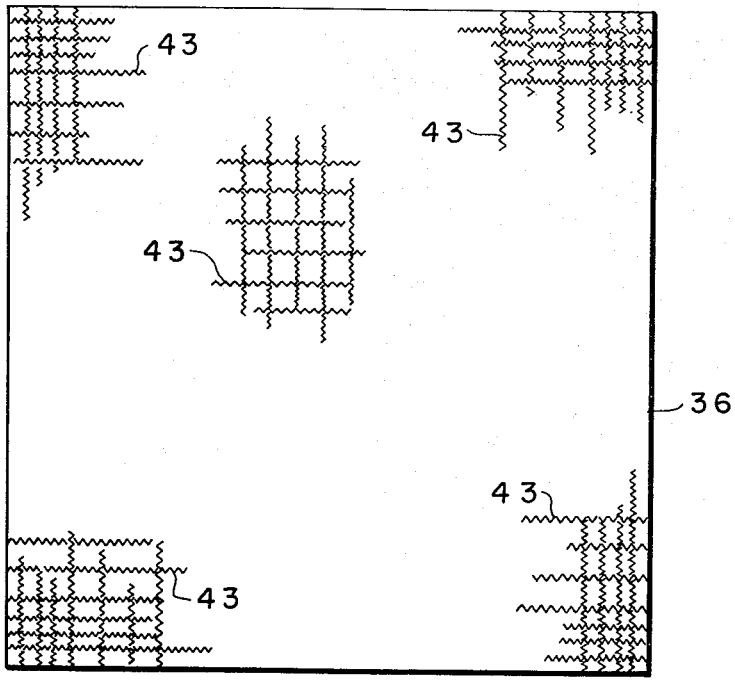
FIG. 3 is a top schematic view of the cutting die used in the invention.

Looking at FIG. 3 it can be seen that the preferred layout of the cutting dies is that of a grid with the spacing between adjacent parallel cutting dies at the edge of the carpet tile being smaller than the spacing towards the interior of the carpet. It has been found that this type of spacing provides a more efficient stress relief pattern than if the spacings between all parallel adjacent cutting dies is the same.

There are many ways to make the cutting die, several of which includes making long continuous corrugated members equal in length or width of the pressure plate 34 and embedding them in the plate. Then the dies in the opposite direction are made in short lengths and fitted in between and perpendicular adjacent long lengths. Conversely, the cutting die can be composed of all small individual segments fitted together and embedded in the pressure plate 34 to provide the die pattern shown in FIG. 3.

It can be seen that an apparatus and method is disclosed which will simply and efficiently provide a carpet tile in which the hardback backing is cut to relieve the stresses therein to a carpet tile which will not pucker upon installation upon a floor.

Although the specific invention has been described, it is contemplated that changes may be made without departing from the scope or spirit of the invention and it is desired that the invention be limited only by the claims.

That which is claimed is: 1. The method of relieving the stress in a hardbacked

1. tile comprising the steps of: providing a carpet tile having a hardback, contacting the hardback of the carpet tile with a cutting die and applying pressure thereto to cut a plurality of substantially continuous lines of varying depth in the hardback of the carpet tile.

* * * * *

UNITED STATES PATENT OFFICE
CERTIFICATE OF CORRECTION

Patent No. 3,968,709 Dated July 13, 1976

Inventor(s) James E. Fowler

It is certified that error appears in the above-identified patent and that said Letters Patent are hereby corrected as shown below:

Column 2, line 3, insert --backing-- after "hardback".

In the Claims -

Claim 1, line 50, insert --carpet-- after "hardbacked".

Claim 1, line 51, delete "1".

Signed and Sealed this

Fourteenth Day of September 1976

[SEAL]

*Attest:*

RUTH C. MASON
*Attesting Officer*

C. MARSHALL DANN
*Commissioner of Patents and Trademarks*